US005996756A

United States Patent [19]

Schmodde et al.

[11] Patent Number: 5,996,756

[45] Date of Patent: Dec. 7, 1999

[54] YARN SUPPLY APPARATUS AND CLUTCH ARRANGEMENT THEREFOR

[75] Inventors: Hermann Schmodde, Horb-Dettlingen; Richard Kaufmann, Freudenstadt; Alfred Lampprecht, Betzweiler-Wälde, all of Germany

[73] Assignee: Memminger-IRO GmbH, Dornstetten, Germany

[21] Appl. No.: 09/088,538

[22] Filed: Jun. 1, 1998

[30] Foreign Application Priority Data

Jun. 16, 1997 [DE] Germany ..... 197 26 027

[51] Int. Cl.[6] ..... F16D 12/04

[52] U.S. Cl. ..... 192/69.7; 192/69.91

[58] Field of Search ..... 192/48.91, 69.7, 192/69.9, 69.91, 114 R

[56] References Cited

U.S. PATENT DOCUMENTS

| | | | |
|---|---|---|---|
| 2,992,715 | 7/1961 | Blachly | 192/69.7 |
| 4,667,867 | 5/1987 | Sumihi | 192/48.91 X |
| 5,497,867 | 3/1996 | Hirsch et al. | 192/48.91 |

FOREIGN PATENT DOCUMENTS

| | | |
|---|---|---|
| 1 245 654 | 2/1965 | Germany . |
| 2 312 933 | 3/1973 | Germany . |
| 30 42 989 A1 | 7/1982 | Germany . |
| 41 41 712 A1 | 6/1993 | Germany . |
| 108049 | 2/1989 | Taiwan . |

*Primary Examiner*—Charles A Marmor
*Assistant Examiner*—Saul Rodriguez
*Attorney, Agent, or Firm*—Frishauf, Holtz, Goodman, Langer & Chick, P.C.

[57] ABSTRACT

A yarn supply apparatus is equipped with a clutch arrangement in order to couple a drive wheel to rotate with a yarn supply wheel as necessary. The clutch arrangement is constructed in an open design, in which any development of narrowing spaces is avoided. For this purpose one clutch half is provided with axial fingers, which engage in radially open longitudinal slots, formed by a toothing, of the other clutch half. The slots of the toothing are longer than the engagement length between fingers and toothing. The intermediate space formed between the ends of the fingers and the nearest wall in axial direction is open in radial direction or is in communication with a larger inner space. Thereby the compression or compaction of deposited fluff is prevented.

26 Claims, 9 Drawing Sheets

YARN SUPPLY APPARATUS AND CLUTCH ARRANGEMENT THEREFOR

FIELD OF THE INVENTION

The invention relates to a clutch arrangement for yarn supply apparatus, as well as a yarn supply apparatus equipped with such a clutch arrangement.

BACKGROUND

Textile machinery or accessory apparatus therefor often needs clutch arrangements with which rotatable machine parts can as necessary be affixed to rotate with each other or separated from each other to disengage a driving relationship. Such clutch arrangements usually operate interengagingly. A problem in such clutch arrangements is the relatively large dirt load. Dust in the form of detaching filaments breaks away from the processed yarn and settles on stationary and moving machine parts. Particles of impregnating material also become detached from the yarn, which is often moving at relatively high speed, and then settle as a thin paraffin coating, for example, on the machine parts. The filaments and possibly the particles of impregnating material then form a fluff deposit, which frequently is troublesome and can impair the function of the clutch arrangement.

Clutch arrangements in particular can suffer from fluff deposits. For example, if an engageable teeth clutch is disengaged for some time, fluff (disordered deposits of filaments, dust and other dirt particles such as paraffin, oil and others) can be deposited on the exposed teeth and then be compressed when the teeth clutch is engaged. If this process is repeated several times, in that the clutch is disengaged and then reengaged with fluff deposited on the teeth, so much compacted fluff gradually accumulates on the teeth clutch that it can no longer be adequately engaged.

The inventors have tried to overcome this problem using the yarn supply apparatus known from practice illustrated in FIG. 1. The yarn supply apparatus is provided with a support member 1, which can be fixed with one end 2 to a mating ring of a knitting machine. At the opposite end the base member is provided with an attachment 3 containing a through-hole, in which a shaft 6, which during use is usually vertically oriented, is rotatably mounted by means of two deep-groove ball bearings 4, 5 disposed some distance apart. At its lower end according to FIG. 1, the shaft 6 carries a cage-type yarn supply wheel 7. At its upper end the shaft 6 carries two drive wheels 11, 12, mounted rotatably and disposed some distance apart on the shaft via deep-groove ball bearings 8, 9. Between the drive wheels 11, 12 a clutch piece 15 is seated on and for rotation with a hexagonal segment 14, which in turn is affixed to rotate with the shaft 6. At its two opposite flat sides (top and bottom sides), this clutch piece 15 is provided with externally toothed hubs 16, 17. The external toothings mesh respectively with internal toothings 18, 19 provided on the drive wheels 11, 12, so that the respective drive wheel 11 or 12 is coupled for rotation with the shaft 6 when the clutch piece 15 is engaged with the corresponding drive wheel 11 or 12.

To prevent ingress of dust, fluff or other deposits to the toothings 16, 17, 18 and 19, the clutch piece 15 is provided on both flat sides with tubular attachments 21, 22, which engage in matching annular spaces 23, 24 of the drive wheels 11, 12 and thus close off the clutch arrangement to the outside.

A certain amount of clearance must be available between the respective attachment 21, 22 and the walls of the respective annular space 23, 24, to prevent engagement or frictional coupling of the clutch arrangement in disengaged position. Thus naturally the seal can only be imperfect. Moreover, fluff can collect in the annular spaces 23, 24 and ultimately prevent the clutch piece 15 from being moved axially. While it is indisputable that fluff can therefore penetrate though the annular spaces 23, 24 in the course of time, it is trapped therein during the engagement process, or in other words during constriction of the annular spaces 23, 24. Although the annular spaces 23, 24 are not hermetically sealed, they do not allow the fluff to escape during the engagement process, and to this extent are tight.

Another problem results from a latching arrangement 26 provided on the clutch piece 15. This consists of a ball mounted in a radial bore or of a pin that presses radially inward under spring action and engages in corresponding notches in the hexagonal segment 14. If fretting corrosion develops or fluff penetrates here, proper function can no longer be assured. For example, the coupling piece 15 can be blocked, such that it can no longer be moved axially, or the latching action can fail, so that the clutch piece 15 is no longer retained in its intended positions.

Fretting corrosion can also develop between the clutch piece and the hexagonal segment, whereby the clutch piece can become jammed.

From DE 30 42 989 A1 (Federal Republic of Germany) there is known a yarn supply apparatus for textile machinery which is provided with a rotatably mounted, driven yarn supply wheel. The yarn supply wheel is coupled with a drive wheel via a clutch arrangement. The clutch arrangement is a shiftable interengageable clutch, one clutch half of which is provided with studs extending in axial direction and the other clutch half of which is provided with corresponding holes to receive the studs.

Fluff can be deposited on the clutch halves and then be compacted when the clutch halves are closed together. Deposited and compacted fluff layers can ultimately become so thick that the clutch can no longer be reliably engaged.

This problem is seen analogously in the yarn supply apparatus known from TW 108049 (Taiwan). The yarn supply apparatus is provided with a teeth clutch, the clutch halves of which are provided on the face side with toothed bushings or attachments bearing on mating faces. Deposits in this region can prevent proper engagement.

THE INVENTION

On this basis, it is the object of the invention to provide a yarn supply apparatus and a clutch arrangement that are less sensitive to soiling and/or require less maintenance.

Briefly, the clutch arrangement according to the invention is provided with at least two clutch halves, of which at least one is mounted axially slidingly, so that interengaging clutch elements can be engaged and disengaged. The clutch elements of at least one of the clutch halves are free-standing and, in addition, both clutch halves are constructed such that no subspaces of decreasing volume are formed or partitioned off during engagement of the clutch. This is achieved by ensuring that the free-standing clutch elements do not define a closed space when the clutch is engaged. It contrasts with the case of the teeth clutch according to FIG. 1, in which the hub provided with the toothing 16 forces fluff into the corresponding recess of the drive wheel 11. In contrast, the clutch arrangement according to the invention has an open design, in which there are provided, in the immediate vicinity of the free-standing clutch elements, free spaces through which fluff compacted by the clutch elements can emerge or at least be removed from the end region of the clutch elements, so that it cannot accumulate between faces to be moved toward each other.

The open design is achieved by the feature of the clutch elements of at least one clutch half being free-standing. Any bounding surface that together with the other clutch elements encloses the free-standing clutch elements in an (annular) intermediate space is so far distant from the free-standing clutch elements in radial direction that a gap allowing fluff to emerge without hindrance is formed. Furthermore, the free-standing clutch elements must be dimensioned such that their ends do not bear on faces of the other clutch half, and so excessively narrowing gaps are not formed there either. In contrast to the prior art, therefore, no attempt whatsoever was made to seal the clutch to the outside. Instead ingress of fluff is possible by virtue of the open design. By the same token, however, discharge of fluff is also possible, and so if maintenance is needed at all it can be achieved simply by blowing out the freely accessible clutch spaces with a medium such as compressed air. Thus maintenance is facilitated.

The free-standing elements are preferably clutch fingers, which for example are axially oriented and thus each engage via a flank or an edge with the other clutch means. The said means is then provided with corresponding axially disposed slots, which preferably have a length exceeding the engagement length in coupled condition. Moreover, it is possible to keep the slots open at both ends, so that fluff can emerge there.

If only one segment of the fingers is in contact while in coupled condition, the fingers can be made relatively thick, so as to withstand the torque-induced stresses and strains. On the other hand, the slots are not very deep, and so only little fluff has to be pushed by the fingers out of the engagement region of the slots. The (radial) emergence of the fluff can be facilitated by rounding the ends of the fingers. Preferably the clutch fingers are somewhat tapered at their ends, the tips being located in the respectively assigned slot when in the coupled condition. Thereby fluff deposited during the engagement process is lifted out of the slot and removed. Moveover, the tips make it easier for the fingers to mesh in the slots of the toothing of the other clutch half, especially if the teeth are also tapered. The clutch is then self-meshing.

Moreover, the fingers can be rounded at their respective end to be brought into engagement with the other clutch elements, whereby adherence of fluff is largely prevented. Otherwise, however, the cross section is preferably triangular, and the slots are shaped correspondingly.

In principle, both clutch halves can be provided with free-standing clutch elements. Preferably, however, a toothing on one clutch half is combined with free-standing clutch elements on the other clutch half. Thereby the clutch connection has little backlash in almost any rotational position. The free-standing clutch elements are preferably disposed at relatively large distances from each other, so that only a few slots are cleared during engagement. As a result, relatively large amounts of fluff cannot be compressed and compacted. If fluff is compressed into other slots during a subsequent engagement process, the previously formed fluff bundles can be urged outward by centrifugal force, thus being eliminated from the clutch arrangement.

The soiling problem occurring in conventional latching arrangements is overcome by the fact that there is provided as the fixing arrangement a tongue preferably constructed as a latch, formed from a relief-cut segment of a hub. Thus the latching tongue is also a largely free-standing element, which does not compress or compact any fluff during its movement.

Advantageously the clutch arrangement is constructed such that only plastic surfaces bear on each other. For example, the entire clutch is formed from plastic parts, so that no fretting corrosion can develop and the clutch arrangement can be actuated even when it has been used for a very long time in a corrosive environment, without ever having been shifted.

By virtue of the novel design of the clutch arrangement, a yarn supply apparatus equipped with a clutch arrangement as described in the foregoing is simpler to maintain and less sensitive to the danger of becoming nonfunctional with time. It can even be used to supply yarns that lead to relatively heavy fluff deposits, without impairment by such deposits of the functional ability of the clutch arrangement or of the shifting ability.

DRAWINGS

FIG. 1 shows a schematic longitudinal section through a yarn supply apparatus according to the prior art, FIG. 2 shows a perspective view of a clutch arrangement according to the invention for the yarn supply apparatus according to FIG. 1, FIG. 2*a* shows a side view of the clutch arrangement according to FIG. 2, FIG. 3 shows a perspective exploded diagram of the clutch arrangement according to FIG. 2 on a different scale, FIG. 4 shows a schematic longitudinal section through the clutch arrangement according to FIGS. 2 and 3 on a different scale, FIG. 5 shows a front view of a clutch half, provided with free-standing clutch elements, of the clutch arrangement according to FIGS. 2 to 4, FIG. 6 shows a top view of a clutch half, mounted axially slidingly, of the clutch arrangement according to FIGS. 2 to 4, FIG. 7 shows a side view of a modified embodiment of the clutch arrangement according to the invention, and FIG. 8 shows a perspective exploded diagram of the clutch arrangement according to FIG. 7.

DETAILED DESCRIPTION

Figure 1:
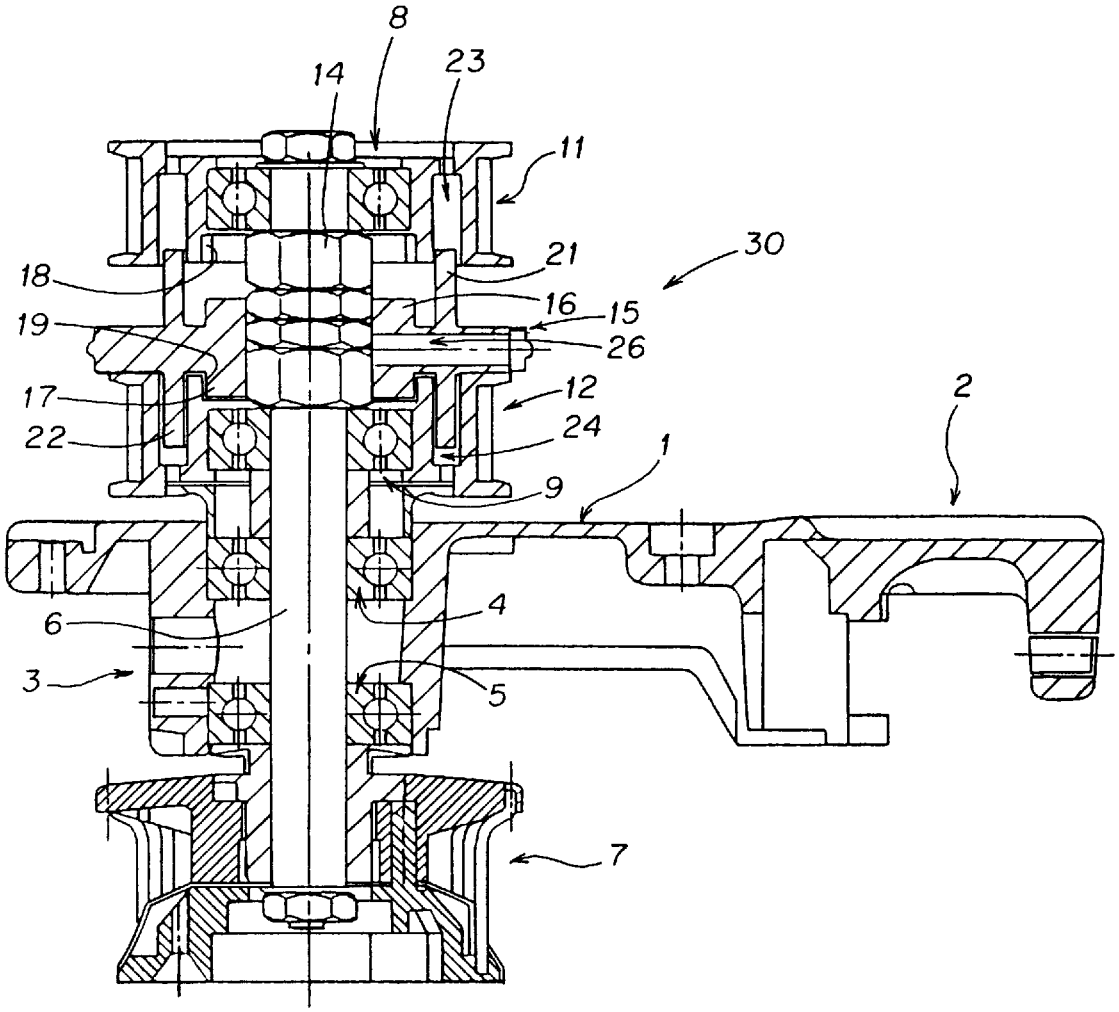

In common with the prior art yarn supply apparatus illustrated in FIG. 1, the yarn supply apparatus according to the invention is provided with a base or support member 1, which is equipped for being connected and fixed to a chassis ring of a knitting machine. On the base member 1 there is mounted, by means of the deep-groove ball bearings 4, 5 or other kind of rolling bearings, the shaft 6, which carries at its lower end the yarn supply wheel 7 and at its upper end the drive wheels 11, 12, which are mounted rotatably thereon by means of the deep-groove ball bearings 8, 9. The drive wheels 11, 12 are provided with external toothing or with other profiling, so that they can be brought into non-slipping engagement with a corresponding drive belt (toothed belt).

The drive wheels 11, 12 and the clutch piece 15 together form a clutch arrangement 30, which is constructed differently from that of the diagram in FIG. 1.

Figure 2:
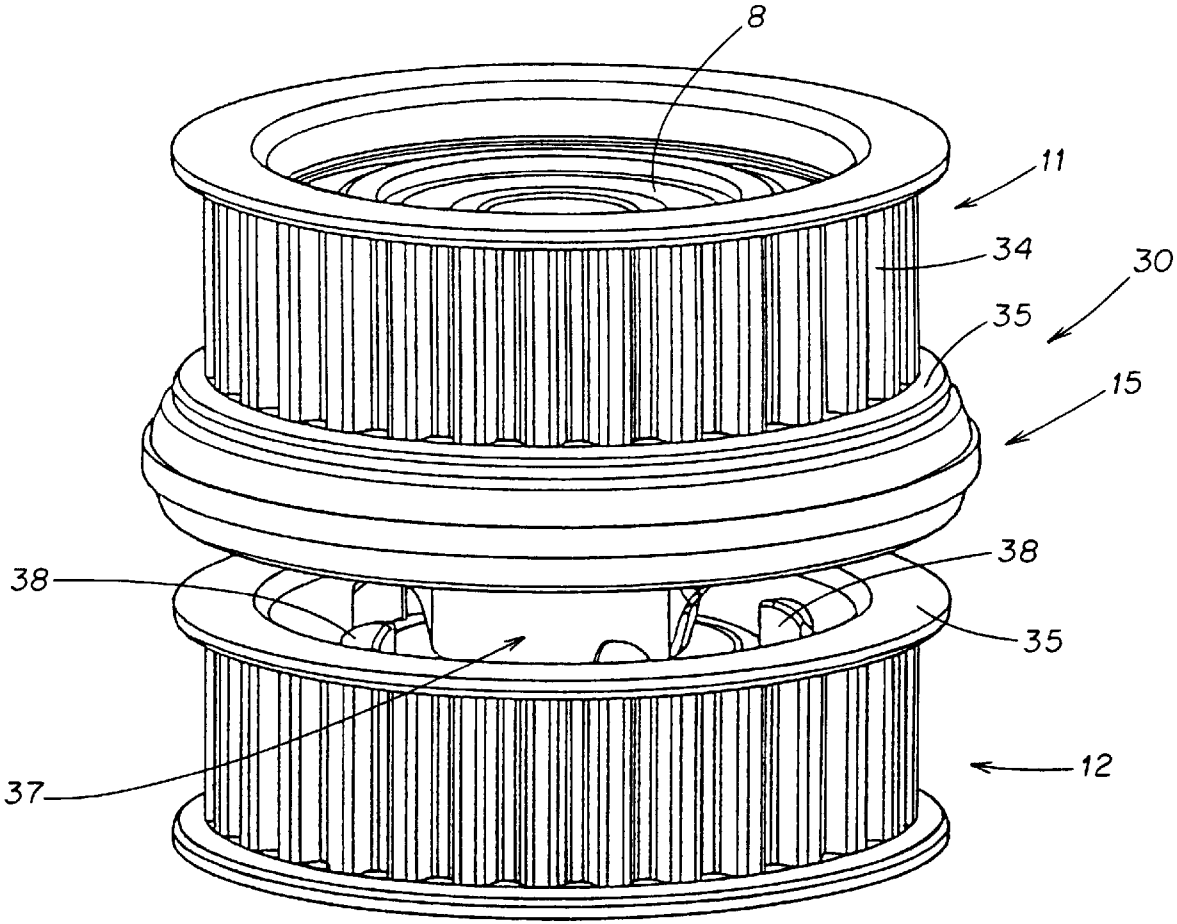

The clutch arrangement 30 according to the invention is illustrated as a complete assembly or separated into parts in FIGS. 2 to 6. The clutch arrangement 30 shown in FIG. 2 is a shiftable clutch, in which the clutch wheel 15 coupled for rotation with the through shaft, which is not further shown, can be engaged alternatively either with the drive wheel 11 or the drive wheel 12. The drive wheels 11, 12 are toothed-belt wheels driven with different speeds and/or in different directions of revolution.

Figure 2A:
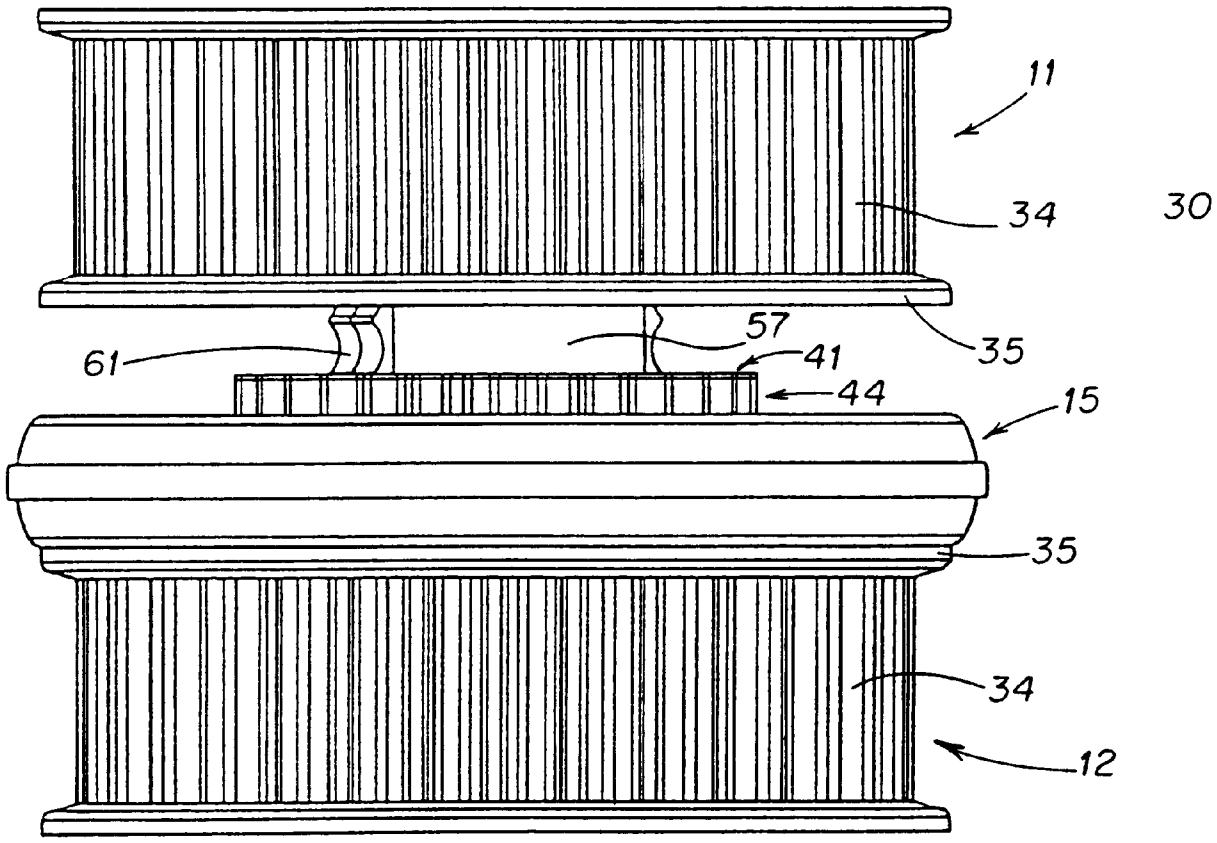
Figure 3:
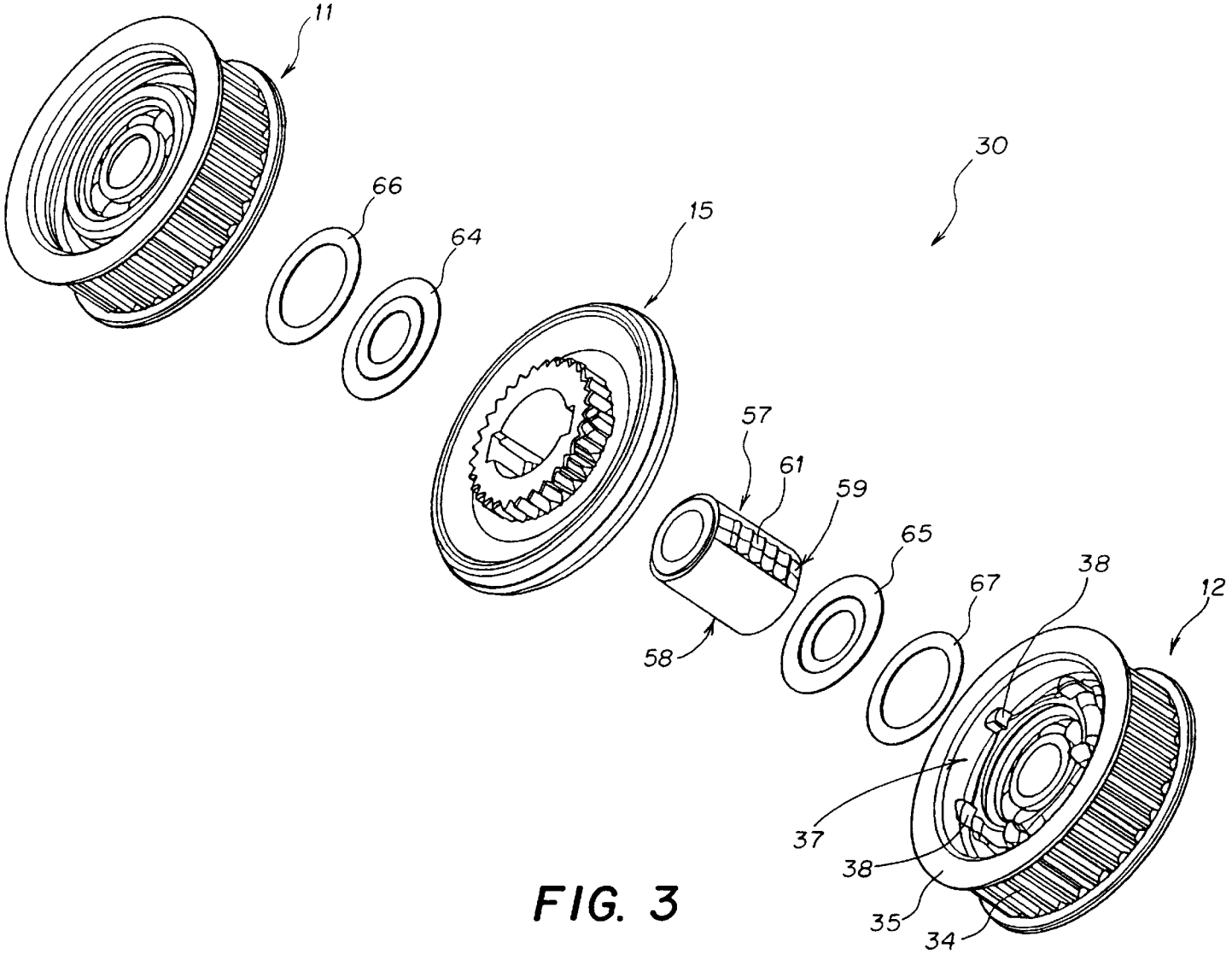

The structure of the clutch arrangement 30 is illustrated in detail in FIGS. 2, 2*a* and 3. The drive wheels 11, 12 are mounted via the deep-groove ball bearings 8, 9 rotatably on the shaft 6, which is indicated only by its centerline 6' in FIG. 4, but cannot be moved axially therealong. The drive wheels 11, 12 are of identical construction. They are provided with a bearing seat 31 to accommodate the outer ring 32 of the respective deep-groove ball bearing 8, 9. This approximately annular cylindrical bearing seat 31 is joined via a radially extending web 33 to an annular outer segment 34, which carries the toothing and which is provided at its two axial ends with a flanged rim 35. The web 33 can be constructed as a closed wheel or can be provided with openings.

Figure 5:
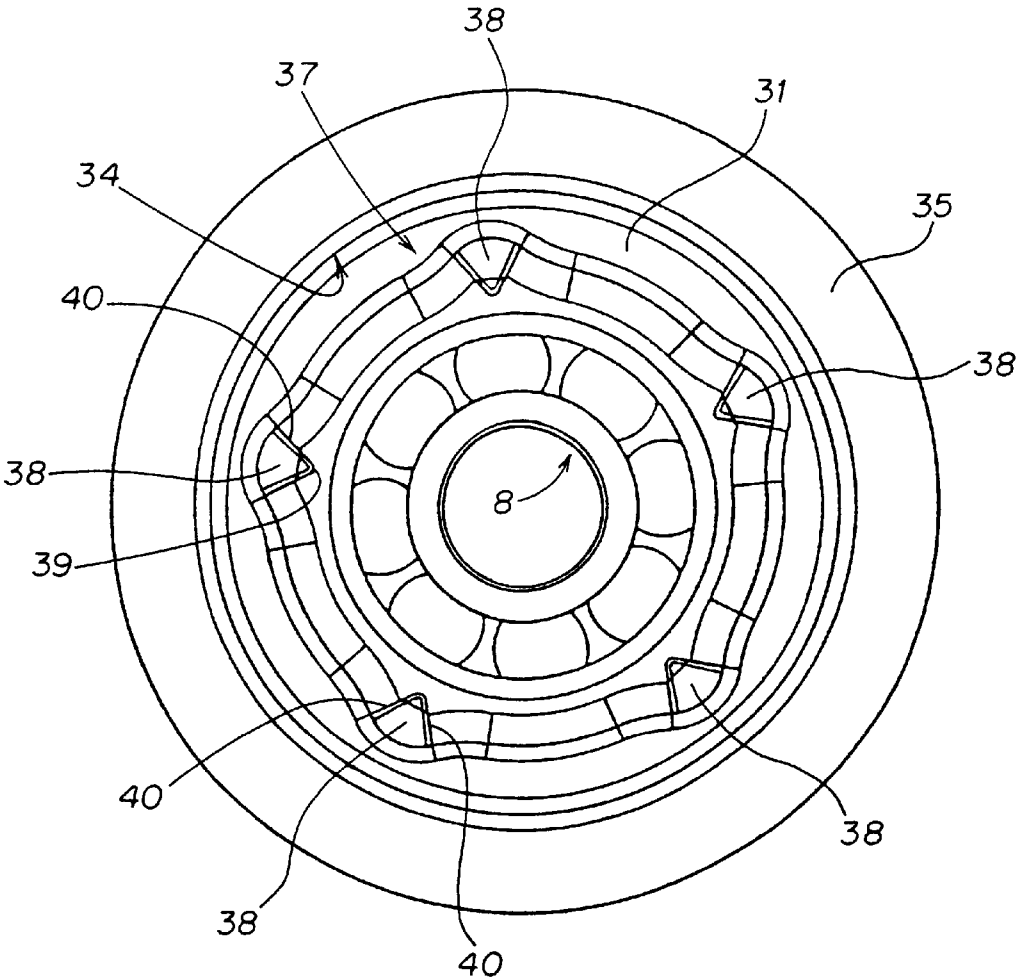

Between the outer segment 34 and the shaft 6 (6') there is bounded an annular inner space 37, which is open in one axial direction. As shown in FIG. 5, five fingers 38 of triangular cross section, extending in axial direction away from the bearing seat 31 and functioning as clutch elements, are disposed in the inner space. The fingers 38 together with the segment of the drive wheel 12 holding them form one clutch half 12*a*.

Figure 4:
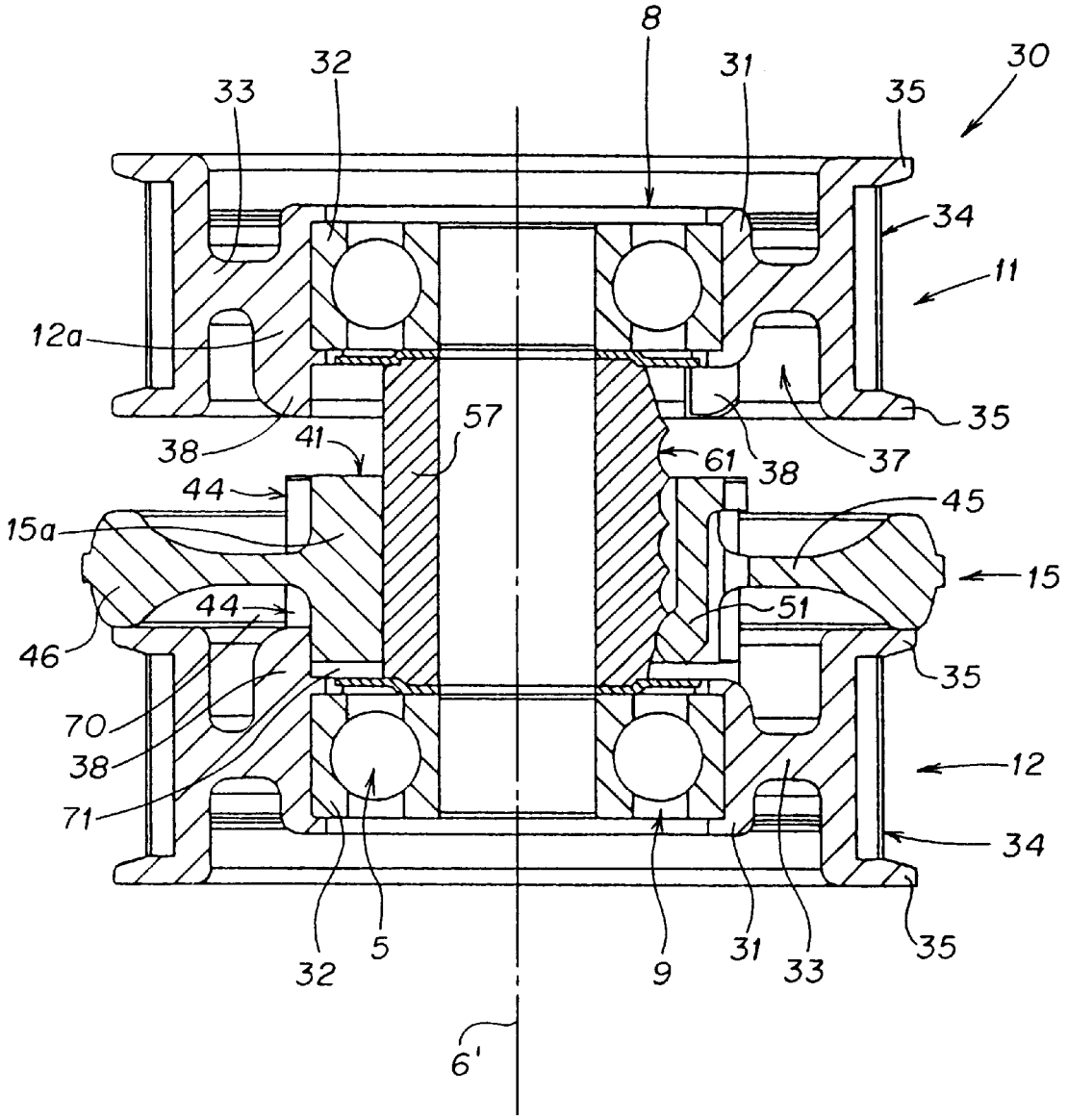

The fingers 38 are disposed at some distance from the approximately cylindrical inner face of the outer segment 34 and are rounded at their sides facing the inner face, as is illustrated in particular in FIG. 5. Moreover, they are rounded at their free end, as illustrated in FIG. 4. Each axially extending finger 38 ends approximately in the plane containing the rim 35 of the outer segment 34. The rim 35 defines a radial annular surface functioning as an abutment. At its radially inner side, each finger 38 is provided with a rectangular or slightly pointed edge 39, which together with the flanks 40 contiguous therewith acts to engage with the clutch piece 15.

Figure 6:
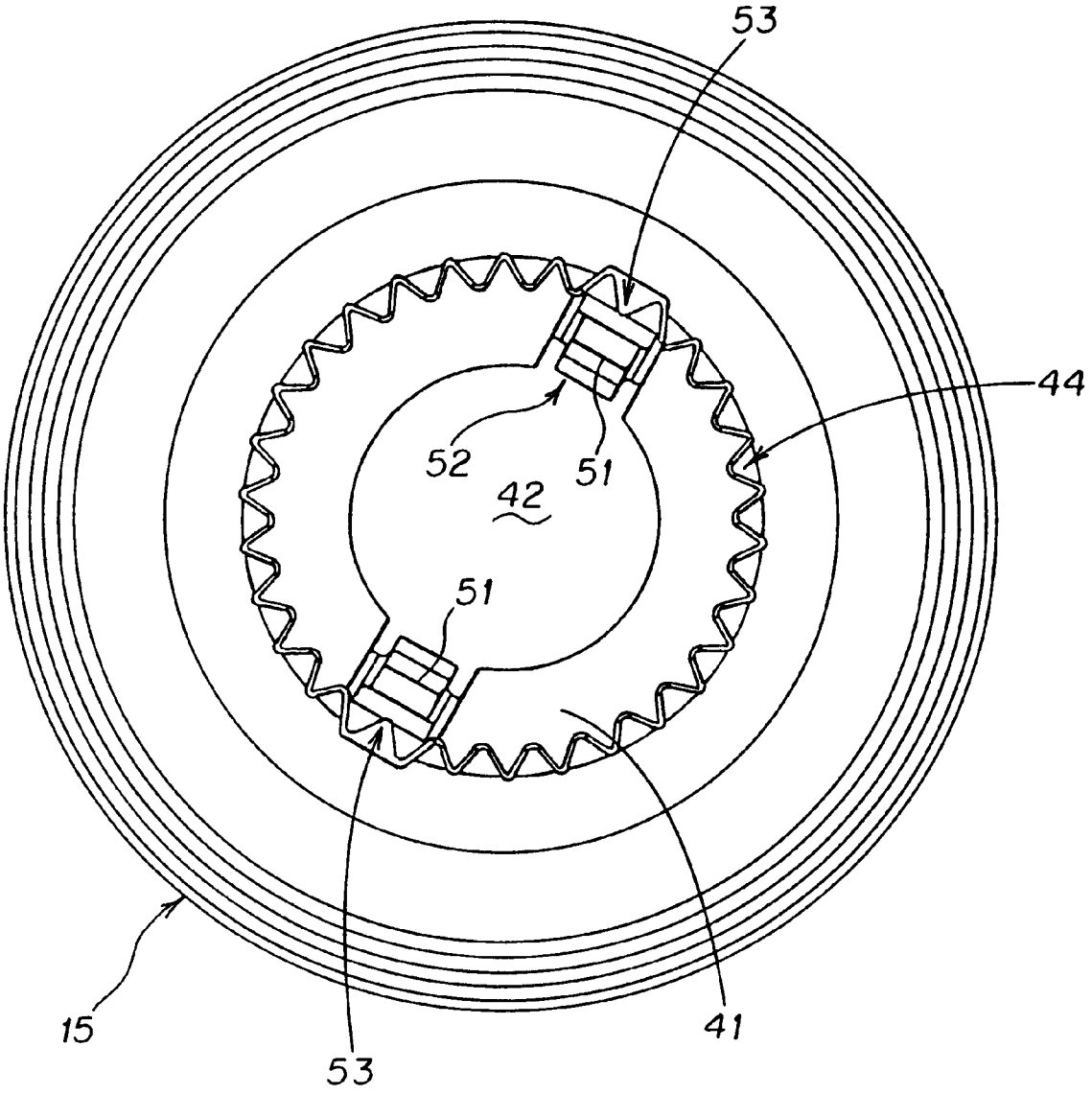

The clutch piece 15 illustrated in FIGS. 3 and 4 as well as separately in FIG. 6 is a one-piece plastic member with a central hub 41, which is provided with a central bore 42 having a cylindrical inner surface. The hub 41 is provided on its radially outer face with a toothing 44, which is constructed such that it can be brought into engagement with the fingers 38 of the drive wheels 11, 12. Thus it forms one clutch half 15*a*. The toothing 44 extends over the entire length of the hub 41 as far as a radially outwardly extending disk-shaped segment 45, which at its radially outer rim is provided with an annularly thickened segment 46. This is provided with a radial annular face, which functions as a stop means for limiting the clutch travel.

The dimensions of the hub 41 and of the outer segment 46, in other words the clutch travel, are matched to each other in axial direction such that the hub 41 extends axially a few millimeters beyond the segment 46. However, this extra length is shorter than the length of the fingers 38, measured from the bearing seat 31 to its front end. The extra length defines the depth of engagement of the clutch arrangement 30.

As FIG. 2*a i* illustrates, part of the toothing 44 of the hub 41 is therefore visibly exposed from the outside.

To immobilize the clutch piece 15 in appropriate engaged or disengaged positions, there are provided two latching tongues 51, 52, which are relief-cut at diametrically opposite points of the hub 41. The latching tongues 51, 52 are attached via one end to the hub at one radial face thereof, while the other end of the latching tongue 51 can spring freely outward in radial direction. As FIG. 6 shows, the hub 41 is provided for this purpose with a corresponding notch 53, which is radially open to the outside. The resilient end of the latching tongue 51 (52) is provided with a convex latching segment. The notches 53 constitute breaks in the toothing 44. However, this does not impair the coupling effect. If one finger 38 is located in the region of a notch 53, force transmission is ensured by the other fingers 38.

As FIGS. 3 and 4 show, a sleeve-like spacer 57 consisting, as does the clutch piece 15, of plastic, is disposed between the drive wheels 11, 12. On its otherwise cylindrical outer surface 58, on which the clutch piece 15 can slide with little slackness, this spacer 57 is provided with two ridge-like projections 59 disposed at diametrically opposite positions. These engage in the notches 53 of the hub 41 and ensure that the spacer 57 and clutch piece 15 are coupled for rotation with each other. Moreover, the spacer 57 is coupled for rotation with the shaft 6.

In addition, the rib-like projections 59 are provided on their radially outer side with a succession of transverse, rounded indentations. These form latching recesses 61 for the rounded end of the tongue 51.

In contrast to the schematic diagram in FIG. 3, the deep-groove ball bearings 8, 9 are factory-sealed. In addition, dished metal washers 64, 65 to accommodate, center and support felt rings 66, 67 are disposed between the spacer 57 and the drive wheels 11, 12. These felt rings absorb any traces of grease that may escape from the deep-groove ball bearings 8, 9 to the clutch arrangement 30, ensuring that as little grease as possible or none at all reaches the region of the fingers 38 or of the toothing 44. In this way the clutch arrangement is kept dry. This acts against fluff deposits.

The clutch arrangement 30 described insofar operates as follows:

Both drive wheels 11, 12 of the clutch arrangement illustrated in FIG. 4 are driven by appropriate belts. The clutch piece 15 is coupled, for example, with drive wheel 12, by the fact that it is pushed sufficiently against the drive wheel 12 that its outer segment 46 bears on the rim 35 of the drive wheel 12. As a result, the fingers 38 of the drive wheel 12 engage between the corresponding teeth of the toothing 44, although their ends do not bear on the disk-like segment 45. Between the ends of the fingers 38 and the segment 45 there remains a fluff space 70, which is not constricted to a gap. Thus fluff is not compressed to a compact deposit.

A fluff space 71 is also left between the end face of the hub 41 and the deep-groove ball bearing 5 or its seal. By virtue of the gaps left between the fingers 38, the fluff space 71 is radially open outwardly into the inner space 37, which can function as a fluff collection space.

Because the clutch piece 15 and the shaft 6 are coupled to rotate with each other, and also because the drive wheel 12 and the clutch piece 15 are coupled to rotate with each other via the toothed engagement therebetween, the yarn supply wheel, which can be seen for example in FIG. 1, is now driven by the drive wheel 12.

The part of the clutch arrangement 30 belonging to the drive wheel 11 is now exposed, and so deposits can form here. In particular, it is possible for fluff to be deposited on the toothing 44. If the upper drive wheel 11 is now activated by pushing the clutch piece 15 upward, the five fingers 38 push the fluff ahead of them and out of the corresponding slots of the toothing 44, without compacting this fluff. This is possible because a space is left between the ends of the fingers 38 and the disk-like segment 45 even in the fully engaged condition. Because of the rounding of the fingers 38, the pushed-out fluff can escape radially outward. This is also assisted by the centrifugal force during rotation of the clutch arrangement 30. Instead of the roundings, the fingers 38 can also be provided on their ends with an inclined surface, so that the finger 38 is provided with a tip located in the slot.

Any compressed bundles of fluff can be spun outward by centrifugal force at the latest after shifting of the clutch when the annular space 37 is reopened to the outside, and so the clutch arrangement 30 has self-cleaning properties. In this way the fluff spaces 70, 71 are kept clean. Moreover, by virtue of its open design, the clutch arrangement 30 is easy to clean by blowing it out with a medium such as compressed air.

Deposited fluff cannot even impair the mobility of the latching tongue 51. This is located in the outwardly open notch 53, and is freely movable therein. A nearby wall over which the latching tongues would move does not exist.

Moreover, the plastic construction of the clutch arrangement 30 also rules out the possibility of development of fretting corrosion, which otherwise could impair the shifting ability of the clutch arrangement 30.

Figure 7:
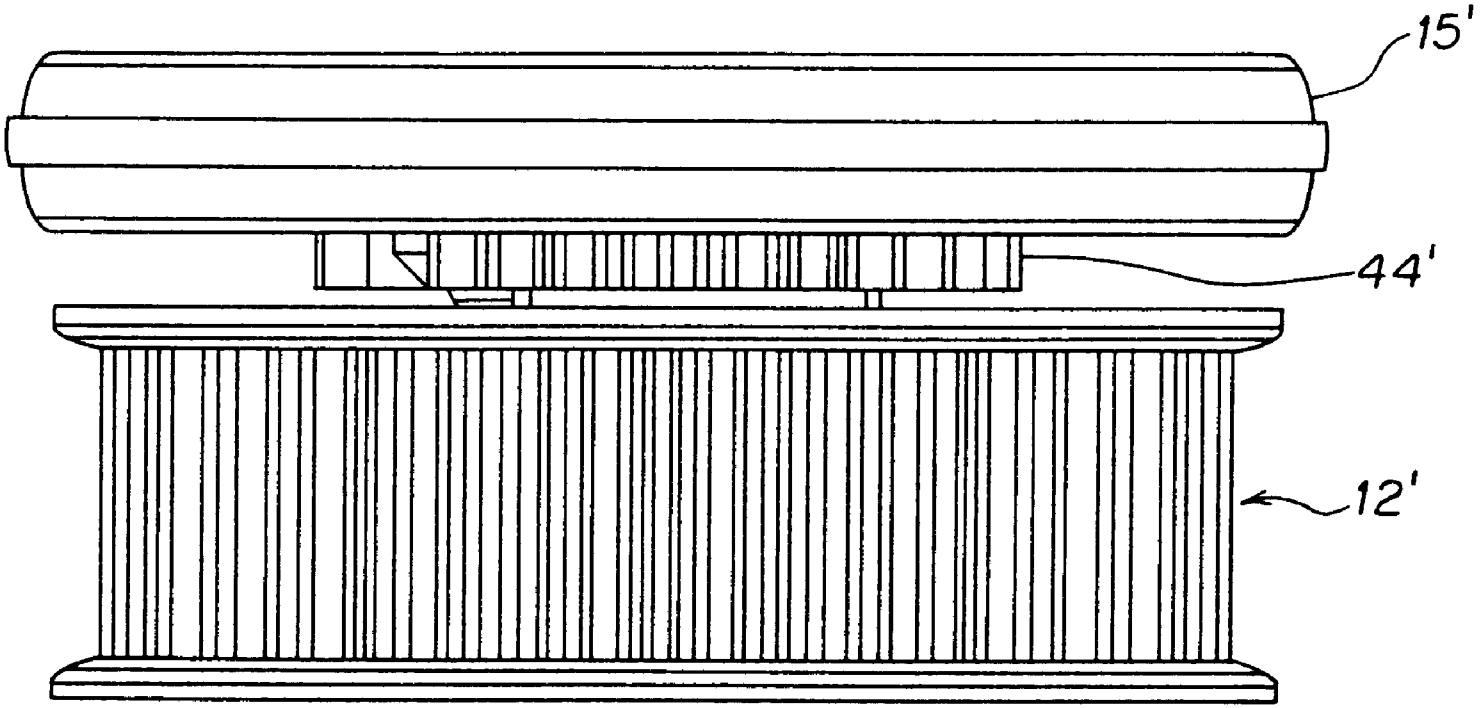
Figure 8:
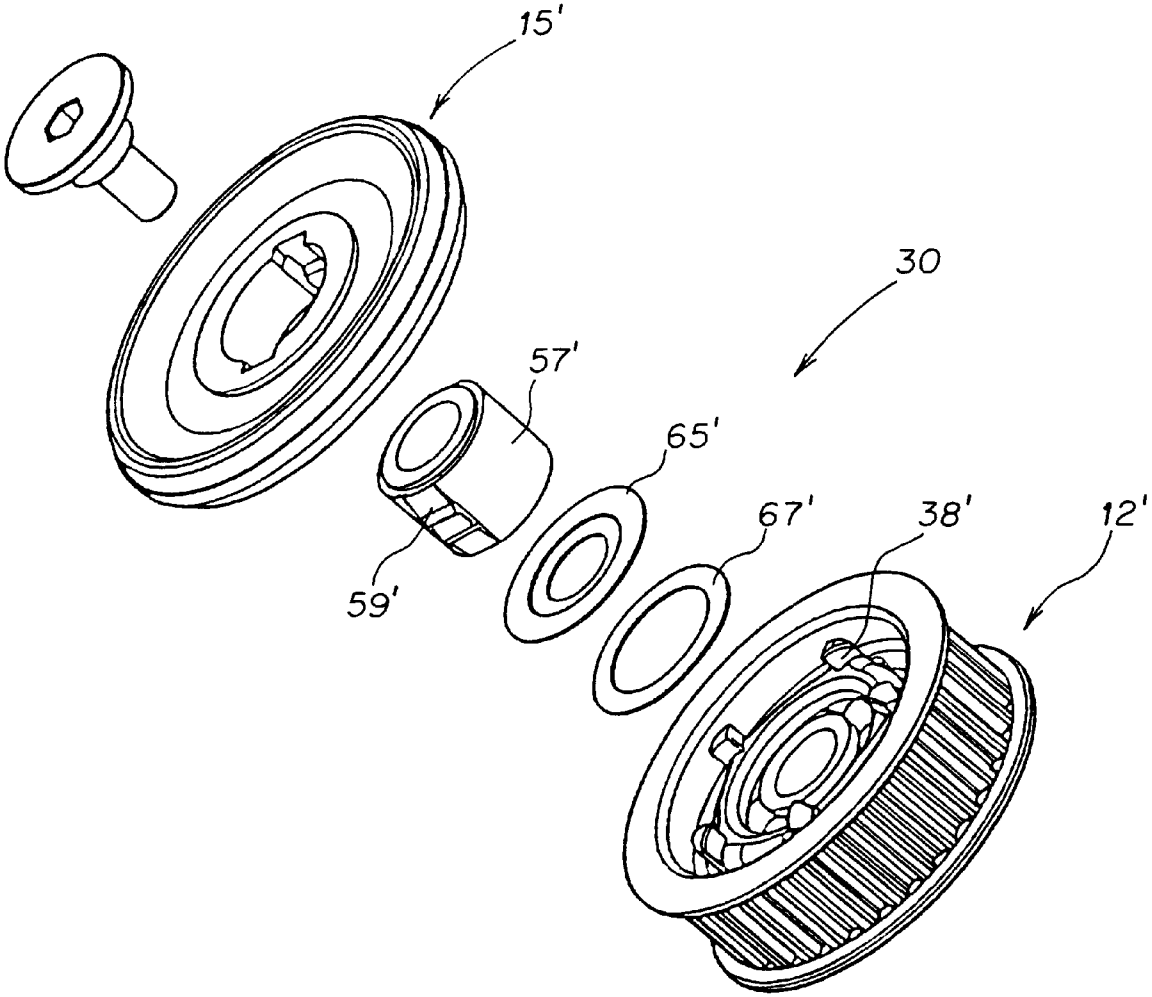

The embodiment illustrated in FIGS. 7 and 8 is a simple clutch arrangement 30' with only one drive wheel 12'. The main difference relative to the embodiment described in the foregoing is that the drive wheel 11 has been omitted. The drive wheel 12' is identical to the drive wheel 12 of the embodiment described in the foregoing. The clutch piece 15' is provided at only one end with a hub and corresponding toothing, the description of which corresponds to that of the clutch piece 15.

A yarn supply apparatus is equipped with a clutch arrangement 30 in order to couple a drive wheel 12 for rotation with a yarn supply wheel 7 as necessary. The clutch arrangement 30 is made with open construction, in which creation of any compacting spaces is avoided. For this purpose one clutch half is provided with axial fingers that engage in radially open longitudinal slots, formed by a toothing 44, in the other clutch half. The slots of the toothing 44 are longer than the engagement length between fingers 38 and toothing 44. The intermediate space formed between the front ends of the fingers 38 and the nearest wall in axial direction is open in radial direction or is in communication with a larger inner space 37. Thereby compression or compaction of deposited fluff is prevented.

We claim:

1. A clutch arrangement (30), especially for a yarn supply apparatus, comprising:

at least one first clutch half **(12*a*) which is rotatable mounted and connected with a drive means (34) and which includes a plurality of first interengaging clutch elements (38), and a second clutch half (15*a*) which is rotatably mounted concentrically with the first clutch half (12*a*) and connected with a driven means (6), and which includes a plurality of second interengaging clutch elements (44), wherein at least one of the first and second clutch halves (15*a*) is axially movable so that it can be moved to and from the respective other clutch half (12*a*) to enable the plurality of first and second interengaging clutch elements (38, 44) to engage and disengage, wherein the first and second clutch halves (12*a*, 15*a*) are constructed such that, in an engaged condition, an open fluff space (70, 71) remains between the plurality of first and second interengaging clutch elements and respective faces of the first and second clutch halves (12*a*, 15*a*)** or adjacent thereto, the faces of the first and second clutch halves being moved toward each other during the engagement process and being accessible to fluff deposition, in both an engaged and disengaged condition the fluff space being fluidly coupled with a region exterior with respect to the clutch arrangement to enable removal of the fluff from the fluff space.

2. A clutch arrangement according to claim 1, wherein the open fluff space (70, 71) is bounded in an axial direction by the faces of the first and second clutch halves **(12*a*, 15*a*)** moving to and from each other and is open in a radial direction.

3. A clutch arrangement according to claim 1, wherein the second of the axially movable clutch half **(15*a*) is limited by at least one stop means (46), which is connected with the second clutch half (15*a*) and in the engaged condition bears on a corresponding abutment (35) connected to the first clutch half (12*a*)**.

4. A clutch arrangement according to claim 3, wherein the stop means (46) includes at least one radially outwardly disposed portion, which after engagement of the first and second clutch halves **(12*a*, 15*a*) bears on a respective face of the first clutch half which forms the abutment and which blocks further axial movement of the first and second clutch halves (12*a*, 15*a*)**.

5. A clutch arrangement according to claim 4, wherein the stop means (46) and the abutment (35) are annular faces.

6. A clutch arrangement according to claim 4, wherein when the stop means (46) and the abutment (35) are at their respective positions most proximate one another, a collection space (37) is formed which is not radially accessible to the region exterior with respect to the clutch arrangement.

7. A clutch arrangement according to claim 6, wherein the plurality of first interengaging clutch elements (38) have a triangular cross section.

8. A clutch arrangement according to claim 7, wherein the plurality of second interengaging clutch elements (44) (38) comprise triangular slots.

9. A clutch arrangement according to claim 1, wherein the plurality of first interengaging clutch elements (38) are disposed in a collection space (37) which is not radially accessible to the region exterior with respect to the clutch arrangement and which in an engaged condition is bounded in an axial direction by the first and second clutch halves **(12*a*, 15*a*)**.

10. A clutch arrangement according to claim 1, wherein the plurality of second interengaging clutch elements (44) comprise a toothing (44).

11. A clutch arrangement according to claim 1, wherein the plurality of first interengaging clutch elements (38) are disposed at distances from each other that are greater than the width of each of the plurality of first interengaging clutch elements (38) measured in an axial direction.

12. A clutch arrangement according to claim 1, wherein the second clutch half (15) can be secured axially in its axial position with a fixing arrangement (51), at least in the engaged position and in the disengaged position.

13. A clutch arrangement according to claim 12, wherein the fixing arrangement (51, 61) is a latching arrangement.

14. A clutch arrangement according to claim 1, wherein the clutch arrangement (30) comprises plastic parts.

15. A clutch arrangement (30), especially for a yarn supply apparatus, comprising:

at least one first clutch half **(12*a*) which is rotatably mounted and connected with a drive means (34) and which includes a first plurality of interengaging clutch elements (38), and a second clutch half (15*a*) which is rotatably mounted concentrically with the first clutch half (12*a*) and connected with a driven means (6), and which includes a plurality of second interengaging clutch elements (44), wherein at least one of the first and second clutch halves (15*a*) is axially movable so that it can be moved to and from the respective other clutch half (12*a*) to enable the plurality of first and second interengaging clutch elements to engage and disengage, wherein the first and second clutch halves (12*a*, 15*a*) are constructed such that, in the engaged condition, an open fluff space (70, 71) remains between faces of the first and second clutch halves (12*a*, 15*a*) or adjacent thereto, the faces of the first and second clutch halves being moved toward each other during the engagement process and being accessible to fluff deposition, in both an engaged and disengaged condition the fluff space being fluidly coupled with a region exterior with respect to the clutch arrangement, and wherein the plurality of first interengaging clutch elements (38)** are free-standing axially directed fingers.

16. A clutch arrangement according to claim 15, wherein the plurality of second interengaging clutch elements (44) comprise axially disposed slots.

17. A clutch arrangement according to claim 15, wherein the plurality of second interengaging clutch elements (44) comprise axially disposed slots; and wherein when the free-standing axially directed fingers (38) are in an engaged condition, only a radially inner or outer zone thereof is engaged with the axially disposed slots (44).

18. A clutch arrangement according to claim 15, wherein the plurality of second interengaging clutch elements (44) comprise axially disposed slots; and wherein when the free standing axially directed fingers (38) are in an engaged condition, the free standing axially directed fingers are engaged with the axially disposed slots (44) over a length shorter than the length of the axially disposed slots (44).

19. A clutch arrangement (30), especially for a yarn supply apparatus comprising:

at least one first clutch half **(12*a*) which is rotatably mounted and connected with a drive means (34) and which includes a first plurality of interengaging clutch elements (38), and a second clutch half (15*a*) which is rotatably mounted concentrically with the first clutch half (12*a*) and connected with a driven means (6), and which includes a plurality of second interengaging clutch elements (44), wherein at least one of the first and second clutch halves (15*a*) is axially movable so that it can be moved to and from the respective other clutch half (12*a*) to enable the plurality of first and second interengaging clutch elements to engage and disengage, wherein the first and second clutch halves (12*a*, 15*a*) are constructed such that, in the engaged condition, an open fluff space (70, 71) remains between faces of the first and second clutch halves (12*a*, 15*a*) or adjacent thereto, the faces of the first and second clutch halves being moved toward each other during the engagement process and being accessible to fluff deposition, in both an engaged and disengaged condition the fluff space being fluidly coupled with a region exterior with respect to the clutch arrangement, and wherein the plurality of first interengaging clutch elements (38) are rounded at their ends facing the second clutch half (15*a*)**.

20. A clutch arrangement according to claim 19, wherein the plurality of first interenqaginq clutch elements (38) are chamfered, rounded or tapered at their sides facing away from the plurality of second interengaging clutch elements (44).

21. A clutch arrangement (30), especially for a yarn supply apparatus, comprising:

at least one first clutch half **(12*a*) which is rotatably mounted and connected with a drive means (34) and which includes a first plurality of interengaging clutch elements (38), and a second clutch half (15*a*) which is rotatably mounted concentrically with the first clutch half (12*a*) and connected with a driven means (6), and which includes a plurality of second interengaging clutch elements (44), wherein at least one of the first and second clutch halves (15*a*) is axially movable so that it can be moved to and from the respective other clutch half (12*a*) to enable the plurality of first and second interengaging clutch elements to engage and disengage, wherein the first and second clutch halves (12*a*, 15*a*) are constructed such that, in the engaged condition, an open fluff space (70, 71) remains between faces of the first and second clutch halves (12*a*, 15*a*) or adjacent thereto, the faces of the first and second clutch halves being moved toward each other during the engagement process and being accessible to fluff deposition, in both an engaged and disengaged condition the fluff space being fluidly coupled with a region exterior with respect to the clutch arrangement, and wherein in at least one of an engaged position and a disengaged position, the second clutch half (15*a*) is axially secured in its axial position with a fixing arrangement (51), and wherein the fixing arrangement (51, 61) includes at least one tongue formed on one of the first and second clutch halves (15)**, the tongue extending in an axial direction and being supported in a radial direction by a spring.

22. A clutch arrangement according to claim 21, wherein the tongue is constructed as a relief-cut segment of a hub (41).

23. A clutch arrangement (30), especially for a yarn supply apparatus, comprising:

at least one first clutch half **(12*a*) which is rotatably mounted and connected with a drive means (34) and which includes a first plurality of interengaging clutch elements (38), and a second clutch half (15*a*) which is rotatably mounted concentrically with the first clutch half (12*a*) and connected with a driven means (6), and which includes a second interengaging clutch element (44), wherein at least one of the first and second clutch halves (15*a*) is axially movable so that it can be moved to and from the respective other clutch half (12*a*) to enable the plurality of first and second interengaging clutch elements to engage and disengage, wherein the first and second clutch halves (12*a*, 15*a*) are constructed such that, in the engaged condition, an open fluff space (70, 71) remains between faces of the first and second clutch halves (12***a*, 15*a*) or adjacent thereto, the faces of the first and second clutch halves being moved toward each other during the engagement process and being accessible to fluff deposition, in both an engaged and disengaged condition the fluff space being fluidly coupled with a region exterior with respect to the clutch arrangement, and wherein the first and second clutch halves (12, 15) are rotatable mounted relative to each other by means of at least one rolling bearing (9) and wherein the rolling bearing (9) is sealed with respect to the plurality of first and second clutch elements (38, 44) and includes an absorbing means (66, 67) for a lubricant.

24. A clutch arrangement according to claim 23, wherein the rolling bearing (9) is seated with its inner ring on a shaft (6) functioning preferably as a driven means and carrying the second clutch half (15), its outer ring carrying the first clutch half (12), and in that the rolling bearing is sealed by means of a felt washer (67), which is clamped between the inner ring of the rolling bearing (9) and at least one profiled piece (57) seated on the shaft (6), on which piece one of the first and second clutch halves (15) is slidingly mounted.

25. A yarn supply apparatus comprising a clutch arrangement (30) which includes:

at least one first clutch half (12*a*) which is rotatably mounted and connected with a drive means (34) and which includes a plurality of first interengaging clutch elements (38), and a second clutch half (15*a*) which is rotatably mounted concentrically with the first clutch half (12*a*) and connected with a driven means (6), and which includes a plurality of second interengaging clutch elements (44), wherein at least one of the first and second clutch halves (15*a*) is axially movable so that it can be moved to and from the respective other clutch half (12*a*) to enable the plurality of first and second interengaging clutch elements (38, 44) to engage and disengage, wherein the first and second clutch halves (12*a*, 15*a*) are constructed such that, in an engaged condition, an open fluff space (70, 71) remains between the plurality of first and second interengaging clutch elements and respective faces of the first and second clutch halves (12*a*, 15*a*) or adjacent thereto, the faces of the first and second clutch halves being moved toward each other during the engagement process and being accessible to fluff deposition, in both an engaged and disengaged condition the fluff space being fluidly coupled with a region exterior with respect to the clutch arrangement to enable removal of the fluff from the fluff space.

26. A clutch arrangement comprising:

a first clutch half being rotatably mounted, said first clutch half having drive means and a plurality of first interengaging clutch elements, said first clutch half having a first engaging surface on an outer peripheral edge thereof;

a second clutch half being rotatably mounted concentrically with the first clutch half and being coupled to a driven member, said second clutch half having a plurality of second interengaging clutch elements which are complementary to the plurality of first interengaging clutch elements, said second clutch half having a second engaging surface on an outer peripheral edge thereof;

wherein at least one of said first and second clutch halves is axially moveable such that said at least one clutch half is movable toward and away from the other of said at least one clutch half to enable the plurality of first and second interengaging clutch elements to engage and disengage; and wherein when said at least one clutch half is moved toward the other of said at least one clutch half, said first and second engaging surfaces of said first and second clutch halves limit an extent of engagement of the plurality of first and second interengaging clutch elements such that a space, which is fluidly coupled to a region outside the clutch arrangement to enable removal of debris, is maintained between at least a leading edge of the plurality of first interengaging clutch elements and the second clutch half to prevent compression of the debris.

* * * * *